US007986903B2

(12) United States Patent
Park

(10) Patent No.: US 7,986,903 B2
(45) Date of Patent: Jul. 26, 2011

(54) TRANSFER DEVICE AND IMAGE FORMING APPARATUS HAVING THE TRANSFER DEVICE

(75) Inventor: Moon-bae Park, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 873 days.

(21) Appl. No.: 11/867,739

(22) Filed: Oct. 5, 2007

(65) Prior Publication Data

US 2008/0219715 A1 Sep. 11, 2008

(30) Foreign Application Priority Data

Mar. 6, 2007 (KR) ..... 10-2007-0022027

(51) Int. Cl.
*G03G 15/08* (2006.01)

(52) U.S. Cl. ..... 399/121

(58) Field of Classification Search ..... 399/121, 399/302, 308
See application file for complete search history.

(56) References Cited

U.S. PATENT DOCUMENTS

2006/0119029 A1* 6/2006 Kitamura ..... 271/275
* cited by examiner

*Primary Examiner* — David M Gray
*Assistant Examiner* — Gregory H Curran
(74) *Attorney, Agent, or Firm* — Stanzione & Kim, LLP

(57) ABSTRACT

An image forming apparatus capable of preventing meandering of a transfer belt. The image forming apparatus includes a main body, including an image forming unit; and a transfer device to transfer an image formed by the image forming unit to a printing medium. The transfer device includes a transfer belt; at least one pair of rollers to rotatably support the transfer belt; a supporting unit to rotatably support both ends of the pair of rollers; and an eccentric unit to movably support a first end of a first roller of the pair of rollers with respect to the supporting unit, the first end deviating from an axis of the first roller.

40 Claims, 10 Drawing Sheets

TRANSFER DEVICE AND IMAGE FORMING APPARATUS HAVING THE TRANSFER DEVICE

CROSS-REFERENCE TO RELATED APPLICATIONS

This application claims priority under 35 U.S.C. §119 (a) of Korean Patent Application No. 10-2007-0022027, filed on Mar. 6, 2007, in the Korean Intellectual Property Office, the disclosure of which is incorporated herein by reference in its entirety.

BACKGROUND OF THE INVENTION

1. Field of the Invention

The present general inventive concept relates to a transfer device which transfers an image to a printing medium, and an image forming apparatus having the same.

2. Description of the Related Art

In general, image forming apparatuses, such as copiers, printers, facsimile machines, and multi-function machines embodying the functions of the above mentioned devices in a single device, have a function of printing an image on a printing medium. Such image forming apparatuses include a feeding unit to feed the printing medium, a developing unit to develop an image on an photoconductive medium, a transfer device to transfer the developed image onto the printing medium, a fixing unit to fix the transferred image onto the printing medium, and a discharging unit to discharge the printing medium to the outside. Among these units, an example of the transfer device is illustrated in FIG. 1.

Referring to FIG. 1, a transfer device of a conventional image forming apparatus includes a transfer belt 20, which is supported and rotated by a pair of rollers 11 and 12. The transfer belt 20 receives an image from a photoconductive medium and transfers the received image onto a printing medium while rotating. At this time, one of the pair of rollers 11 and 12 is a driving roller 11, which receives a driving force from a driving source, and the other is a tension roller 12. Both ends of the tension roller 12 are supported by an elastic member 12*a* to apply a tension to the transfer belt 20.

However, the transfer belt 20 meanders in an axial direction of the tension roller 12 while rotating. Such a meandering operation of the transfer belt 20 during rotation causes the transfer quality to deteriorate and damages the transfer belt 20. In order to address such a problem, a method is provided in which a supporting projection 21 is formed on an inside surface of the transfer belt 20, and a guide groove 12*b* is formed in the tension roller 12 to engage with the supporting projection 21.

However, even if the supporting projection 21 and the guide groove 12*b* are provided, the transfer belt 20 continuously meanders due to changes in the elastic force of the elastic member 12*a* which is applied to the transfer belt 20, and deviates from the rotation path of the transfer belt 20. If the transfer belt 20 meanders for an extended period of time, the supporting projection 21 may also become disengaged from the guide groove 12*b*.

SUMMARY OF THE INVENTION

The present general inventive concept provides a transfer device and an image forming apparatus having the same which have an improved structure so as to prevent a transfer belt from meandering while rotating to enhance a transfer efficiency.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a transfer device including a transfer belt; at least one pair of rollers to rotatably support the transfer belt; a supporting unit to rotatably support both ends of the pair of rollers; and an eccentric unit to movably support a first end of a first roller of the pair of rollers with respect to the supporting unit, the first end deviating from an axis of the first roller.

The first roller may be a tension roller having a shaft protruding from both ends and being elastically supported by a first and a second elastic member which provide tension to the transfer belt.

The eccentric unit may support a first end of the tension roller to deviate from an axis of the shaft.

The supporting unit may include a frame; and a first and a second support member to allow the first and second ends of the tension roller to be securely supported on the frame, the first and second support members individually including a first shaft hole and a second shaft hole, respectively, into which the first and second ends of the tension roller are inserted.

A first and a second opening may be formed on the frame in order to mount the first and second support members.

The first elastic member may be mounted at the first opening between the frame and the first support member, and the second elastic member may be mounted at the second opening between the frame and the second support member.

The diameter of the first opening may be greater than a first diameter of the first support member to engage with the first opening, and the diameter of the second opening may be equal to a second diameter of the second support member to engage with the second opening.

The eccentric unit may include the first elastic member; a first supporting projection protruding from the frame to support a first end of the first elastic member; a second supporting projection positioned such that an arbitrary centerline is located below an arbitrary centerline of the first supporting projection, the second supporting projection protruding from the first support member so as to face the first supporting projection, to support a second end of the first elastic member; and a moving unit to cause the first end of the tension roller to move upwardly and downwardly by sliding movement of the tension roller combined with an elastic force of the first elastic member.

The moving unit may movably support the first end of the tension roller to be moved between a first position in which the first end of the tension roller deviates from the axis of the second end and a second position in which the first and second ends of the tension roller are coincident with the same axis.

The moving unit may include a first cam having an inclined surface inclined at a predetermined angle, the first cam mounted at the first end of the tension roller; and a second cam protruding from the frame so as to be guided along the inclined surface in combination with the sliding movement of the tension roller.

According to another exemplary embodiment, the diameter of the first shaft hole may be greater than the diameter of the shaft of the tension roller, the diameter of the second shaft hole may be equal to the diameter of the shaft of the tension roller, and the diameters of the first and second openings may be equal to the diameters of the first and second support members for engagement with the first and second openings.

A first and a second supporting projection may extend from the frame and the first support member to support the first and second ends of the first elastic member, respectively. A third and a fourth supporting projection may extend from the frame and the second support member to support a first and a second end of the second elastic member, respectively.

The eccentric unit may include an eccentric member to cause the first end of the tension roller to deviate from an axis of the tension roller; and a moving unit to cause the first end of the tension roller to move upwardly and downwardly by sliding movement of the tension roller combined with an elastic force of the eccentric member.

The eccentric member may be a leaf spring, a first end of which is fixed to the first support member and a second end of which elastically urges the first end of the tension roller to deviate from the axis of the second end in the inner portion of the first shaft hole.

According to another exemplary embodiment, a first and a second supporting projection may extend from the frame and the first support member to support the first and second ends of the first elastic member, respectively, and a third and a fourth supporting projection may extend from the frame and the second support member to support a first and second ends of the second elastic member, respectively.

The eccentric unit may include an eccentric member to cause the first support member to deviate from an axis of the second support member; and a moving unit to cause the first end of the tension roller to move upwardly and downwardly by sliding movement of the tension roller combined with an elastic force of the eccentric member.

The eccentric member may be a leaf spring, a first end of which is fixed to the frame and a second end of which elastically urges the first support member to deviate from the axis of the second support member.

The transfer device may further include a guide unit to guide the floating movement of the transfer belt about the second end of the tension roller.

The guide unit may include a guide boss protruding from the transfer belt; and a guide member including a guide recess into which the guide boss is inserted, the guide member mounted at the second end of the tension roller.

The foregoing and/or other aspects and utilities of the present general inventive concept may also be achieved by providing an image forming apparatus including a main body, including an image forming unit; and a transfer device to transfer an image formed by the image forming unit to a printing medium. The transfer device may include a transfer belt; at least one pair of rollers to rotatably support the transfer belt; a supporting unit to rotatably support both ends of the pair of rollers; and an eccentric unit to movably support a first end of a first roller of the pair of rollers with respect to the supporting unit, the first end deviating from an axis of the first roller.

The foregoing and/or other aspects and utilities of the present general inventive concept may also be achieved by providing a transfer device comprising: a transfer belt; first and second supporting members to rotatably support the transfer belt; and an eccentric unit to movably support a first end of the first supporting member to deviate with respect to a second end thereof.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
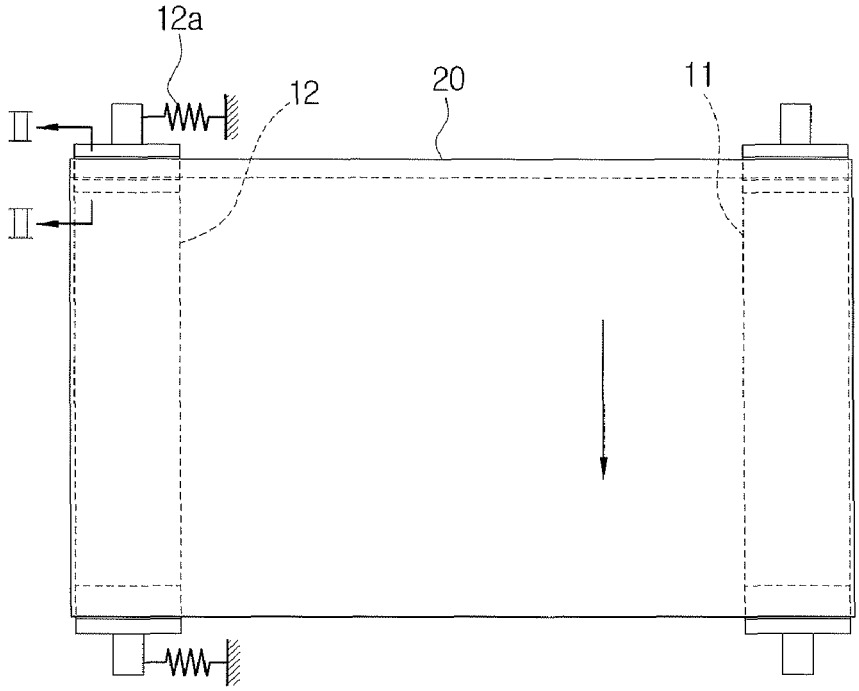
FIG. 1 (PRIOR ART)
FIG. 1 is a plan view schematically illustrating a transfer device of a general image forming apparatus.
Figure 2:
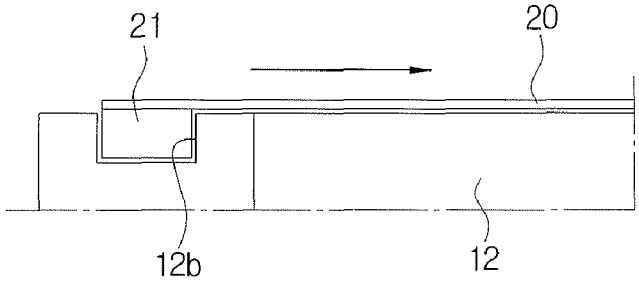
FIG. 2 (PRIOR ART)
FIG. 2 is a sectional view of the transfer device, cut following line II-II in FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Hereinafter, a transfer device and an image forming apparatus having the same according to exemplary embodiments as described herein will now be described in greater detail with reference to the accompanying drawings.

Figure 3:
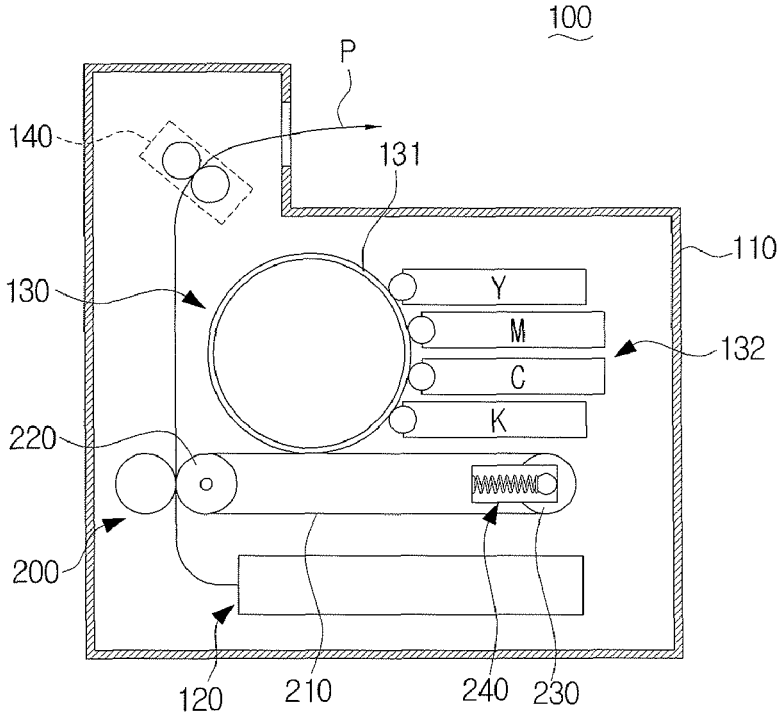
FIG. 3 is a schematic view illustrating a configuration of an image forming apparatus according to an exemplary embodiment of the present general inventive concept.

Referring to FIG. 3, an image forming apparatus 100 according to an exemplary embodiment includes a feeding unit 120 to feed a printing medium P in a main body 110 of the image forming apparatus 100, an image forming unit 130 to form an image, a transfer device 200 to transfer the formed image onto the printing medium P, and a fixing device 140 to fix the transferred image onto the printing medium P.

The image forming unit 130 includes a photoconductive medium 131 on which an electrostatic latent image is formed, and a developing unit 132 to develop the electrostatic latent image using a developer. Since technical constructions of the image forming unit 130 constructed as described above are well-known in the art, detailed description and illustration thereof will be omitted, and only the transfer device 200, which includes features of the present general inventive concept, will be explained in detail.

Figure 4:
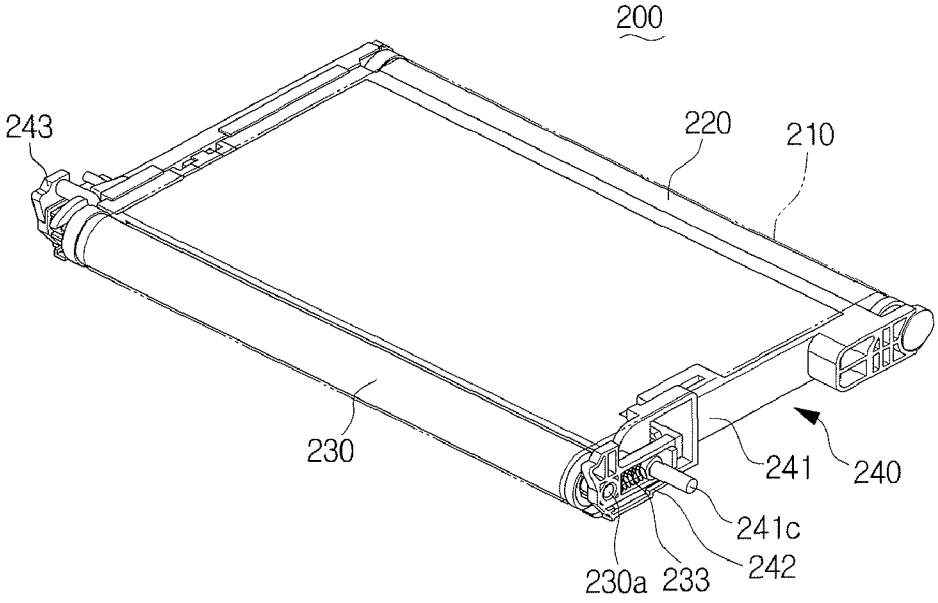
FIG. 4 is a perspective view illustrating a transfer device separated from the image forming apparatus of FIG. 3, according to an exemplary embodiment of the present general inventive concept.
Figure 5:
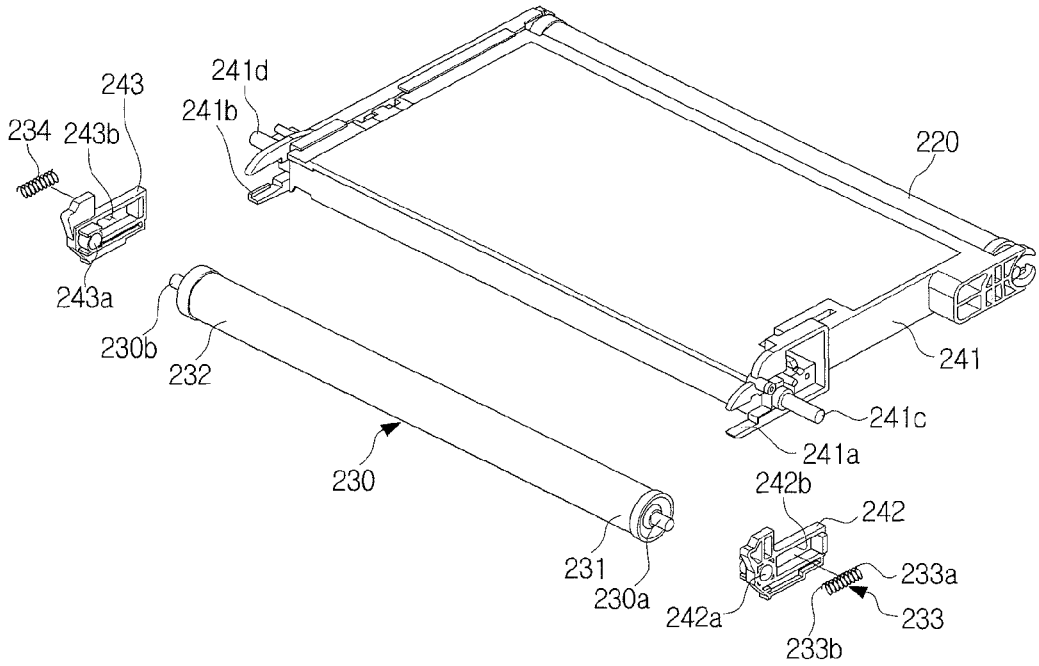
FIG. 5 is an exploded view illustrating the transfer device of FIG. 4.
Figure 8A:
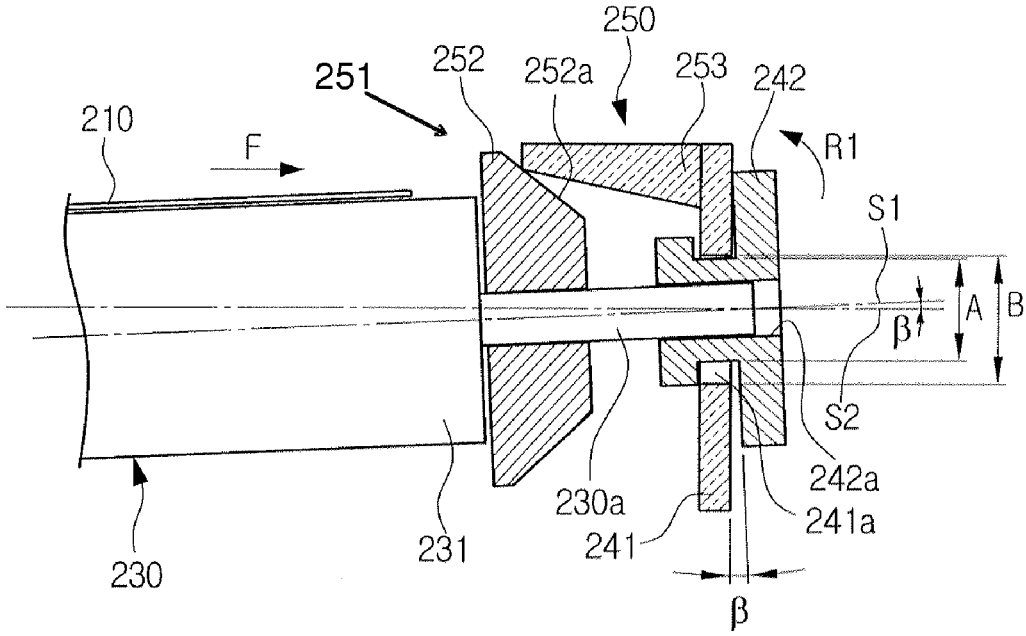
FIGS. 8A to 8C are schematic sectional views illustrating operation states of a tension roller and an eccentric unit according to an exemplary embodiment of the present general inventive concept.

As illustrated in FIGS. 3, 4 and 5, the transfer device 200 according to an exemplary embodiment includes a transfer belt 210, a driving roller 220, a tension roller 230, a supporting unit 240 and an eccentric unit 250 (see, for example, FIG. 8A).

The transfer belt 210 may serve as a transfer medium to receive an image formed by the image forming unit 130, and both ends of the transfer belt 210 may be supported by the driving roller 220 and tension roller 230, respectively, and may be rotated.

The driving roller 220 may rotatably support one end of the transfer belt 210. Additionally, the driving roller 220 is connected to a driving source (not illustrated), which provides a rotation force to rotate the transfer belt 210, and the driving roller 220 transfers a driving force to the transfer belt 210.

The tension roller 230 may rotatably support the other end of the transfer belt 210. A first-end shaft 230*a* and a second-end shaft 230*b* protruding from a first end 231 and a second end 232 of the tension roller 230, respectively, may be elastically supported by a first elastic member 233 and a second elastic member 234, respectively. Accordingly, the tension roller 230 may receive an elastic force from the first and second elastic members 233 and 234 to apply tension to the transfer belt 210.

The supporting unit 240 may rotatably support both ends of the driving roller 220 and tension roller 230. The supporting unit 240 may include a frame 241, a first support member 242, and a second support member 243.

The frame 241 may rotatably support the transfer belt 210, a shaft of the driving roller 220 and the shafts 230*a* and 230*b* of the tension roller 230.

Figure 6A:
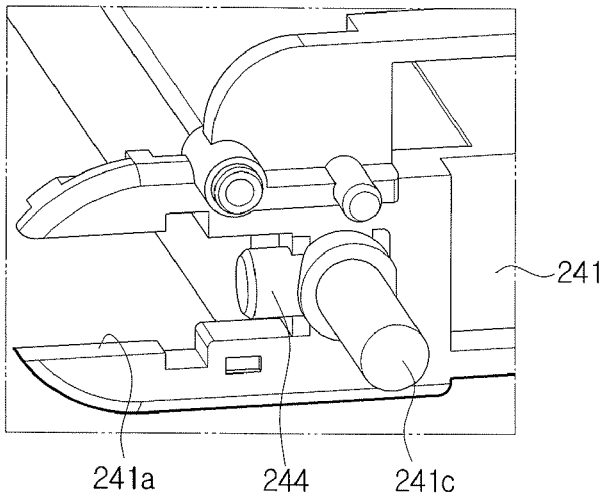
FIGS. 6A to 6C are schematic views illustrating a supporting unit to support a first end of a tension roller illustrated in FIG. 4.
Figure 6B:
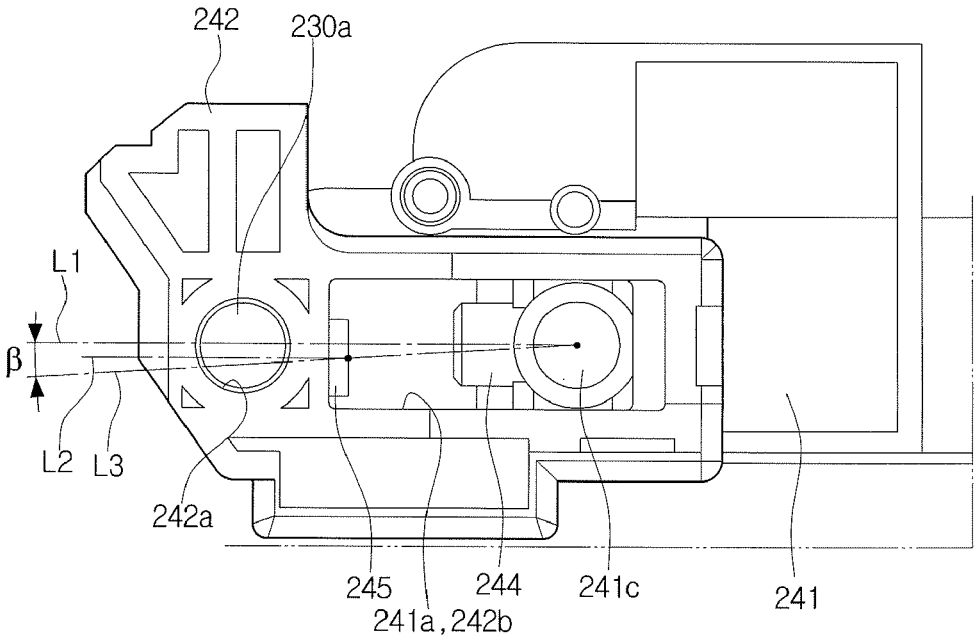
Figure 6C:
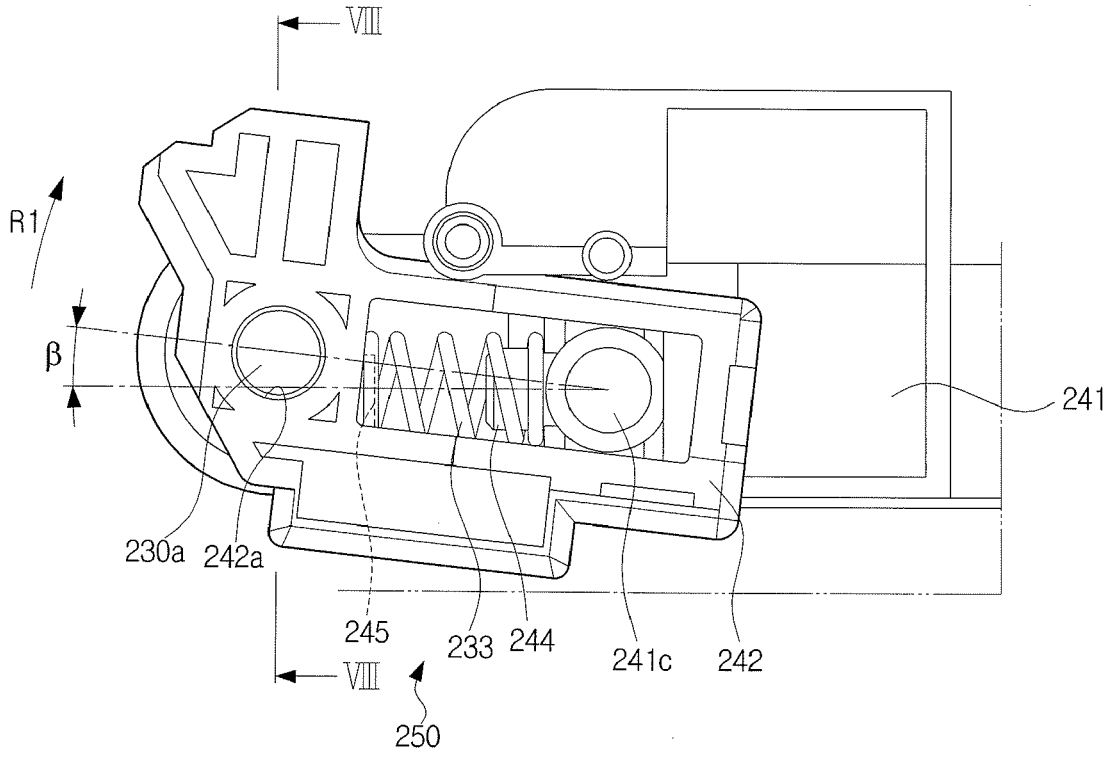

The first and second support members 242 and 243 may allow the first-end shaft 230*a* and second-end shaft 230*b* of the tension roller 230, respectively, to be securely supported on the frame 241. As illustrated in FIGS. 6B, 6C and 7B, the first and second support members 242 and 243 may individually include a first shaft hole 242*a* and a second shaft hole 243*a*, respectively, into which the first-end shaft 230*a* and second-end shaft 230*b* of the tension roller 230 are respectively inserted. The diameters of the first and second shaft holes 242*a* and 243*a* are equal to the diameters of the shafts 230*a* and 230*b* of the tension roller 230.

The first elastic member 233 may be mounted between the first support member 242 and the frame 241. In the same manner, the second elastic member 234 may be mounted between the second support member 243 and the frame 241.

Referring to FIGS. 5 to 8B, a first opening 241*a* and a second opening 241*b* may be formed in the frame 241 in order to mount the first and second support members 242 and 243, respectively. Additionally, a first slot 242*b* and a second slot 243*b* may be formed at the first and second support members 242 and 243, respectively, complementary to the first and second openings 241*a* and 241*b*. The first and second openings 241*a* and 241*b* may be complementary to the first and second slots 242*b* and 243*b*, respectively.

Figure 8B:
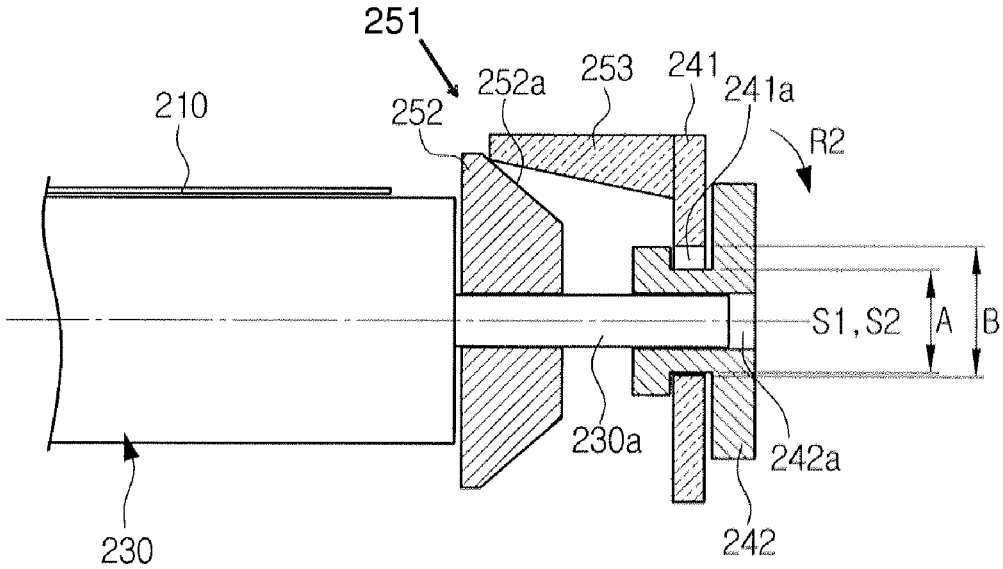
Figure 8C:
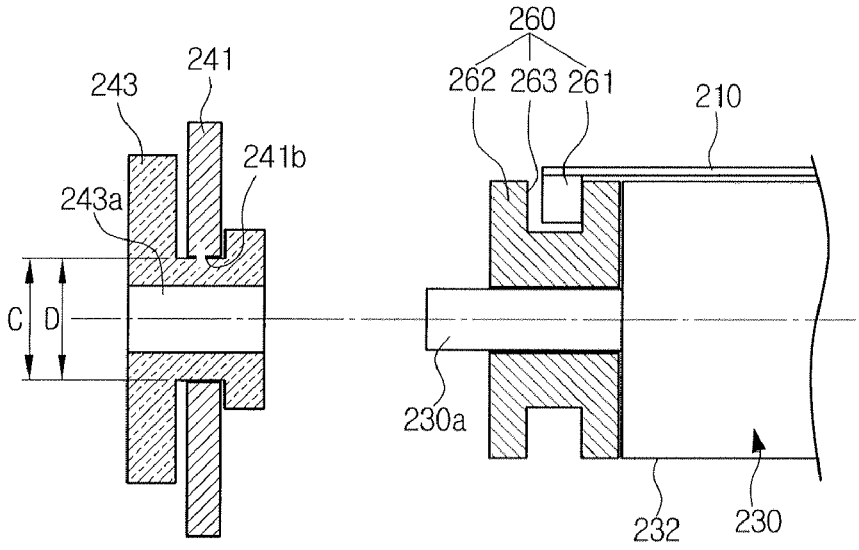

Referring to FIG. 8B, a diameter B of the first opening 241*a* may be greater than a first diameter A of the first support member 242 to engage with the first opening 241*a*. Additionally, the diameter D of the second opening 241*b* may be equal to a second diameter C of the second support member 243 to engage with the second opening 241*b*, as illustrated in FIG. 8C.

A first guide projection 241*c* and a second guide projection 241*d* may protrude from both ends of the frame 241, respectively, and may be respectively inserted into the first and second openings 241*a* and 241*b*. The diameters of the first and second guide projections 241*c* and 241*d* may correspond to the diameters B and D of the first and second openings 241*a* and 241*b*, respectively.

As constructed above, the first support member 242 may move in upward and downward directions R1 and R2 around the first guide projection 241*c* in the inner portion of the first opening 241*a* in combination with the sliding movement, as illustrated in FIGS. 6C and 8B. On the other hand, the second support member 243 may only slide within the second opening 241*b* because there is no space to move in upward and downward directions R1 and R2.

The eccentric unit 250 (see FIG. 8A) may movably support the first end 231 of the tension roller 230 with respect to the supporting unit 240 to deviate in upward and downward directions R1 and R2 from an axis of the tension roller 230, in order to determine the orbit of the transfer belt 210 during initial rotation. Referring to FIGS. 6A, 6B, 6C, 8A and 8B the eccentric unit 250 may include the first elastic member 233, a first supporting projection 244, a second supporting projection 245, and a moving unit 251.

The first elastic member 233 may elastically press the tension roller 230 to apply tension to the transfer belt 210, and at the same time may elastically support the first support member 242 to deviate from an axis of the second support member 243, as illustrated in FIG. 6C.

The first supporting projection 244 may protrude from the frame 241 to support a first end 233*a* of the first elastic member 233.

As illustrated in FIG. 6B, the second supporting projection 245 may be positioned such that an arbitrary centerline L2 may be located below an arbitrary centerline L1 of the first supporting projection 244. The second supporting projection 245 may protrude from the first support member 242 so as to face the first supporting projection 244, to support a second end 233*b* of the first elastic member 233. The arbitrary centerline L1 of the first supporting projection 244 may be coincident with an axis of the first guide projection 241*c*. The second supporting projection 245 may be provided adjacent to the first-end shaft 230*a* of the tension roller 230.

Specifically, the first end 233*a* and the second end 233*b* of the first elastic member 233 may be supported by the first and second supporting projections 244 and 245, respectively, and the first elastic member 233 may be engaged with the first opening 241*a*. The second supporting projection 245 may be lifted in an upward direction R1 to a predetermined eccentric angle β around the first guide projection 241*c* by the repulsive force against the buckling force of the first elastic member 233, based on the different arbitrary centerlines L1 and L2.

The eccentric angle β indicates an angle between the line L3 connecting the center of the first guide projection 241*c* to the center of the second supporting projection 245 and the centerline L1 connecting the center of the first guide projection 241*c* to the center of the first supporting projection 244, as illustrated in FIG. 6B.

As described above, the second supporting projection 245 of the first support member 242 may be lifted in an upward direction R1 to the eccentric angle β, and thus the first end 231 of the tension roller 230 may also be lifted in an upward direction R1 to the eccentric angle β along with the second supporting projection 245. Referring to FIG. 6C, the first-end shaft 230*a* of the tension roller 230 may move in upward and downward directions R1 and R2 at an angle twice the eccentric angle β.

Figure 7A:
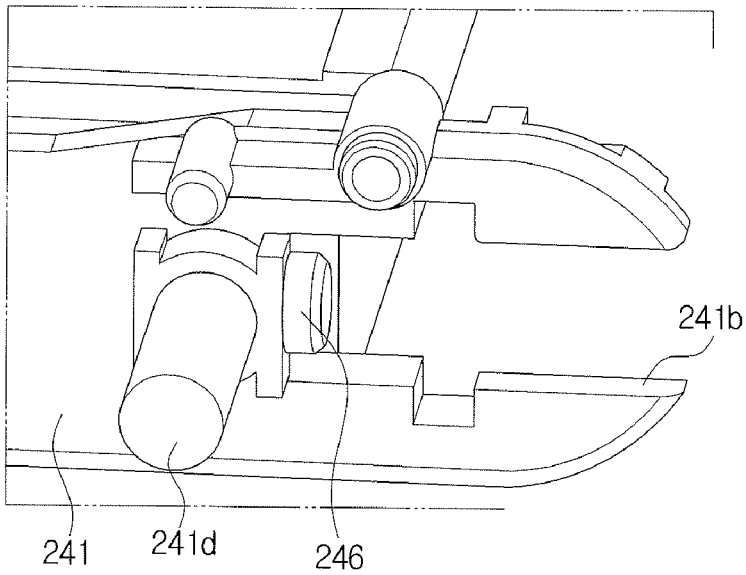
FIGS. 7A and 7B are schematic views illustrating a supporting unit to support a second end of a tension roller illustrated in FIG. 4.
Figure 7B:
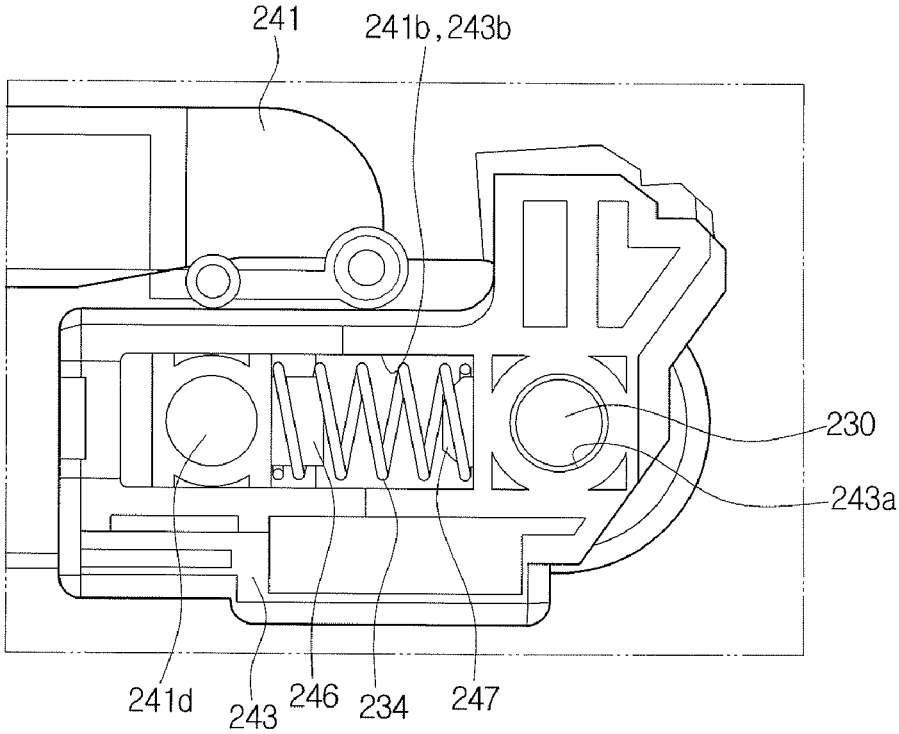

Referring to FIGS. 7A, 7B and 8C, both ends of the second elastic member 234 corresponding to the first elastic member 233 may be supported by a third supporting projection 246 and a fourth supporting projection 247, which are formed at the frame 241 and the second support member 243, respectively. Arbitrary axes of the third and fourth supporting projections 246 and 247 may be coincident with each other. Accordingly, the second elastic member 234 may provide only tension to the transfer belt 220, without applying the buckling force.

The moving unit 251 may cause the first end 231 of the tension roller 230 to move upwardly and downwardly by sliding movement of the tension roller 230 combined with the elastic force of the first elastic member 233. As illustrated in FIGS. 8A and 8B, the moving unit 251 may include a first cam 252 and a second cam 253, and may allow the shafts 230*a* and 230*b* of the tension roller 230 to be disposed at a first position or a second position.

The first position indicates a position in which the first-end shaft 230*a* of the tension roller 230 is lifted in an upward direction R1 to the eccentric angle β about the second-end shaft 230*b* of the tension roller 230. The second position indicates a position in which the first end 231 of the tension roller 230 is moved in a downward direction R2 to the eccentric angle β and the centers of the first-end shaft 230*a* and second-end shaft 230*b* may be identified.

Specifically, referring to FIG. 8A, the first position is a position in which the first end 231 of the tension roller 230 is lifted in an upward direction R1 by a buckling force from the first elastic member 233 so that an axis S1 of the first end of the tension roller 230 can be located above an axis S2 of the second end of the tension roller 230 at the eccentric angle β.

Additionally, referring to FIGS. 8A and 8B, the second position is a position in which the tension roller 230 slides in a direction indicated by arrow F to press the first support member 242 in a downward direction R2 so that the axes S1 and S2 of the first and second ends 231 and 232 can be coincident with each other.

The first cam 252 having an inclined surface 252*a* inclined at a predetermined angle may be mounted at the first end 231 of the tension roller 230. The second cam 253 may protrude from the frame 241 so as to move along the inclined surface 252*a* in combination with the sliding movement of the tension roller 230. In other words, the first and second cams 252 and 253, being in contact with each other, may be linked with the sliding movement of the tension roller 230.

Specifically, as illustrated in FIG. 8A, if the tension roller 230 slides in the direction indicated by arrow F, the first cam 252, mounted at the first end 231 of the tension roller 230, may also move in the direction indicated by arrow F together with the tension roller 230. In this situation, the first end 231 of the tension roller 230 may be pressurized in a downward direction R2 by the second cam 253 being in contact with the inclined surface 252*a* of the first cam 252.

The first end 231 of the tension roller 230 may move along the diameter B of the first opening 241*a* formed at the frame 241 at an angle twice the eccentric angle β. Accordingly, the first end 231 of the tension roller 230 may move in a downward direction R2 from the first position in which the first end 231 of the tension roller 230 is lifted in an upward direction R1, and may be then disposed at the second position in which the axes S1 and S2 of the first and second ends 231 and 232 are coincident with each other.

As illustrated in FIG. 8C, the transfer device according to an exemplary embodiment may further include a guide unit 260 to guide the floating movement of the transfer belt 210 about the second end 232 of the tension roller 230. The guide unit 260 may include a guide boss 261 and a guide member 262.

The guide boss 261 may protrude from the bottom surface of the transfer belt 210. The guide member 262 may include a guide recess 263 into which the guide boss 261 is inserted, and may be mounted at the second end 232 of the tension roller 230.

Operations of the transfer device of the image forming apparatus according to the above-described exemplary embodiment will be described with reference to FIGS. 4 to 8C.

Referring first to FIGS. 4 and 5, the transfer belt 210 may be rotatably supported by the driving roller 220 and tension roller 230.

At this time, the first end 231 of the tension roller 230 may be disposed at the first position in which the first end 231 is lifted in an upward direction R1 to the eccentric angle β around the first guide projection 241*c* by the buckling force of the first elastic member 233 of which the ends are supported by the first and second supporting projections 244 and 245, as illustrated in FIGS. 6B, 6C and 8A.

As illustrated in FIGS. 7B and 8C, the second end 232 of the tension roller 230 is inserted into the second shaft hole 243*a* of the second support member 243 and then engaged with the second opening 241*b* of the frame 241. The diameter D of the second opening 241*b* is the same as the second diameter C of the second support member 243, and accordingly the second end 232 of the tension roller 230 may be supported without floatingly moving in upward and downward directions R1 and R2.

If the transfer belt 210 rotates when the first end 231 of the tension roller 230 is lifted to the eccentric angle β relative to the second end 232 of the tension roller 230, the transfer belt 210 may meander in the direction indicated by arrow F to move towards the first end 231 of the tension roller 230.

Referring to FIG. 8A, the tension roller 230 may also move in the direction indicated by arrow F together with the transfer belt 210 due to the frictional force between the tension roller 230 and the transfer belt 210. At this time, as illustrated in FIG. 8C, the guide boss 261 protruding from the transfer belt 210 is inserted into the guide recess 263 of the guide member 262 mounted at the second end 232 of the tension roller 230.

The second cam 253 may be guided along the inclined surface 252*a* of the first cam 252 by movement of the tension roller 230 in the direction indicated by arrow F, and the first end 231 of the tension roller 230 may be pressurized in a downward direction R2, as illustrated in FIG. 8B. In this situation, the first support member 242 into which the first-end shaft 230*a* of the tension roller 230 is inserted may also be moved in the downward direction R2 within the first opening 241*a* in combination with the movement of the first end 231 of the tension roller 230. In other words, the first-end shaft 230*a* of the tension roller 230 together with the first support member 242 may move in the downward direction R2 at the eccentric angle β, and thus may be disposed at the second position.

Accordingly, the axis S1 of the first end 231 of the tension roller 230 may be coincident with the axis S2 of the second end 232 of the tension roller 230, and thus meandering of the transfer belt 210 in the direction indicated by arrow F may be stopped. The transfer belt 210 may transfer the image developed by the image forming unit 130 to the printing medium P without meandering, as illustrated in FIG. 3.

Figure 9A:
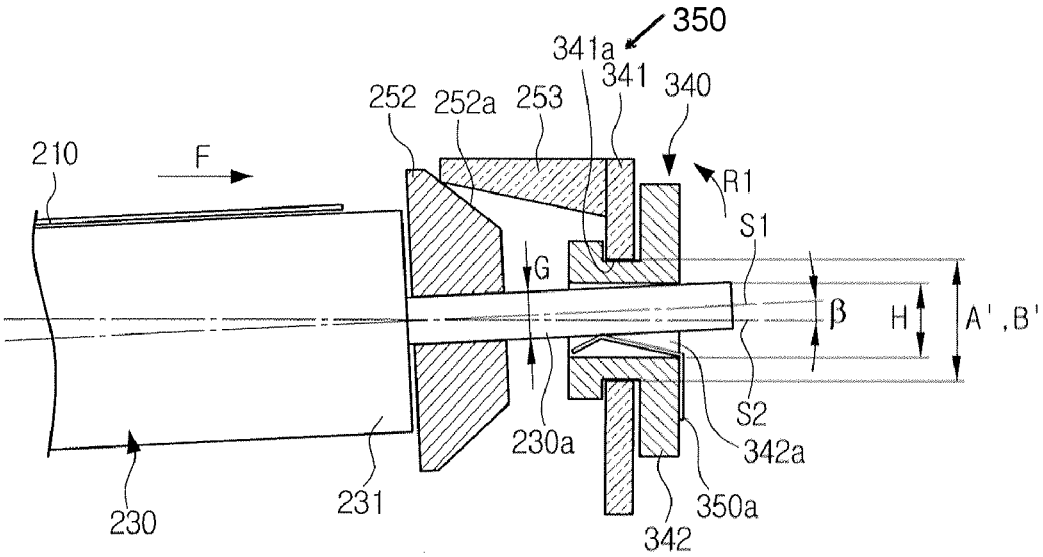
FIGS. 9A and 9B are schematic sectional views illustrating operation states of a tension roller and an eccentric unit according to another exemplary embodiment.
Figure 9B:
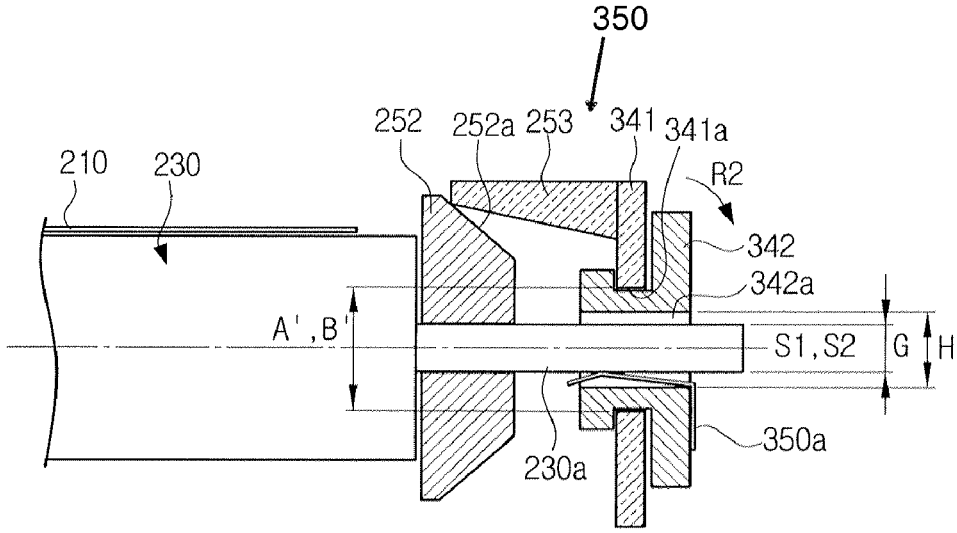

Referring to FIGS. 9A and 9B, an image forming apparatus according to another exemplary embodiment includes the transfer belt 210, the driving roller 220, the tension roller 230, a supporting unit 340, an eccentric unit 350, and a guide unit 260. Since technical constructions of the transfer belt 210, driving roller 220, tension roller 230 and the guide unit 260 are similar to those described in the previous exemplary embodiment, detailed descriptions and illustrations thereof will be omitted. Additionally, when explaining the present exemplary embodiment, the same drawing reference numerals are used for the same technical constructions as described in the previous exemplary embodiment.

In technical constructions according to the present exemplary embodiment, the supporting unit 340 may include a frame 341 including a first opening 341*a* and a second opening (not illustrated, referring to FIG. 5), and a first support member 342 and a second support member 243 which individually include a first shaft hole 342*a* and a second shaft hole 343*a* (same as illustrated in FIG. 8C). A technical construction of the second support member 243 is the same as that described in the previous exemplary embodiment.

The diameter H of the first shaft hole 342*a* may be greater than the diameter G of the shaft 230*a* of the tension roller 230, and the diameter (not illustrated) of the second shaft hole 243*a* may be the same as the diameter G of the shaft 230*b* of the tension roller 230. Additionally, the diameter B' of the first opening 341*a* and second opening (not illustrated) may be the same as the diameter A' of the first and second support members 342 and 243 for engagement with the first opening 341*a* and the second opening (not illustrated), respectively. Accordingly, the shafts 230*a* and 230*b* of the tension roller 230 may be floatingly moved in the first shaft hole 342*a*.

The first supporting projection 244 and the second supporting projection 245 (referring to FIG. 6B) to individually support the first end 233*a* and the second end 233*b* of the first elastic member 233 may be formed on the frame 341 and the first support member 342, respectively. The third and fourth supporting projections 246 and 247 (referring to FIG. 7B) to support both ends of the second elastic member 234 corresponding to the first elastic member 233 may be formed on the frame 241 and the second support member 243, respectively, in the same manner as in the first exemplary embodiment of the present general inventive concept.

Arbitrary centerlines L1 and L2 of the first and second supporting projections 244 and 245 (referring to FIG. 6B) may be coincident with each other. In other words, the first and second supporting projections 244 and 245 may face each other in the same manner as does the third and fourth supporting projections 246 and 247 (referring to FIG. 7B).

Accordingly, the buckling force is not generated from the first elastic member 233 of which the ends are supported by the first and second supporting projections 244 and 245. Instead, in the present exemplary embodiment, an eccentric member 350*a* may be provided to cause the first-end shaft 230*a* of the tension roller 230 to deviate from the axis of the second-end shaft 230*b*.

The eccentric member 350*a* may be a leaf spring, a first end of which is fixed to the first support member 342, and a second end of which elastically urges the first-end shaft 230*a* of the tension roller 230 to deviate from the axis of the second-end shaft 230*b* in the inner portion of the first shaft hole 342*a*.

As constructed above, when the eccentric member 350*a* elastically supports the first-end shaft 230*a* of the tension roller 230 to deviate in an upward direction R1 from the axis of the shafts 230*a* and 230*b* at the eccentric angle β, the transfer belt 210 may meander in the direction indicated by arrow F in rotation. The second cam 253 may be guided along the inclined surface 252*a* of the first cam 252 in combination with the movement of the tension roller 230 in the direction indicated by arrow F, and thus the first end 231 of the tension roller 230 may move in a downward direction R2 at the eccentric angle β. In other words, the first end 231 of the tension roller 230 may move from the first position to the second position.

Therefore, the axis S1 of the first end 231 of the tension roller 230 may be identified with the axis S2 of the second end 232 of the tension roller 230, and thus meandering of the transfer belt 210 can be stopped while the tension roller 210 is rotating.

Figure 10A:
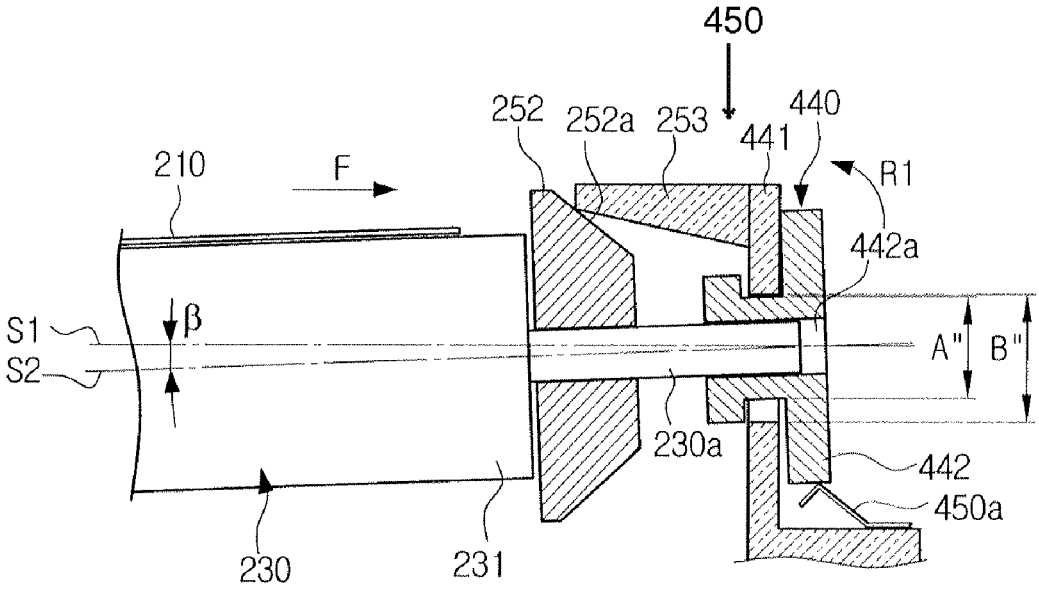
FIGS. 10A and 10B are schematic sectional views illustrating operation states of a tension roller and an eccentric unit according to yet another exemplary embodiment.
Figure 10B:
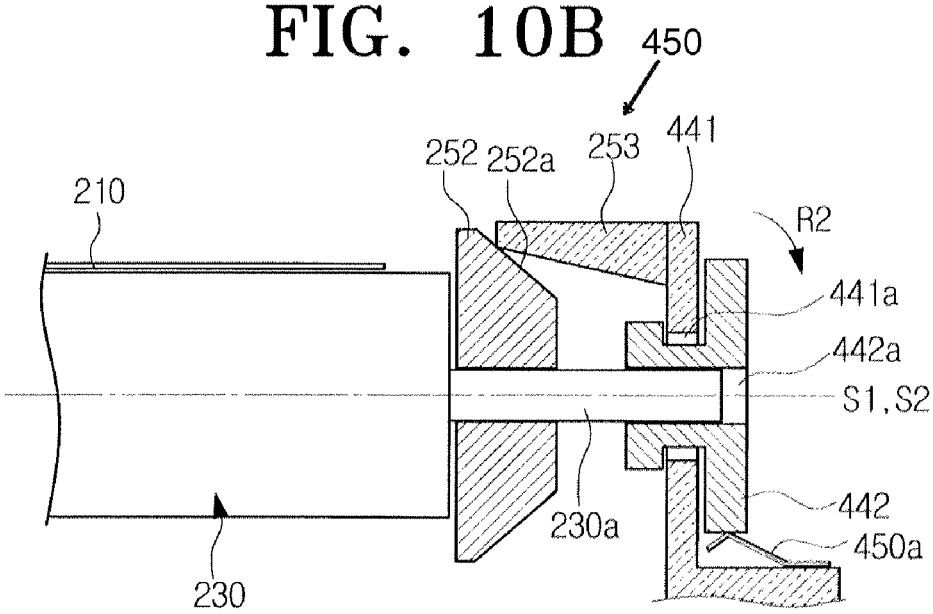

As illustrated in FIGS. 10A and 10B, a transfer device according to another exemplary embodiment includes the transfer belt 210, the driving roller 220, the tension roller 230, a supporting unit 440, an eccentric unit 450, and the guide unit 260, in the same manner as in the previous exemplary embodiments.

Since technical constructions of the transfer belt 210, driving roller 220, tension roller 230 and guide unit 260 are similar to those described in the exemplary embodiment of FIGS. 4 through 8C, detailed descriptions and illustrations thereof will be omitted. Additionally, when explaining the present exemplary embodiment, the same drawing reference numerals are used for the same technical constructions as described in the first exemplary embodiment of the present general inventive concept.

In technical constructions according to the present exemplary embodiment, the supporting unit 440 includes the first to fourth supporting projections 244, 245, 246 and 247 (referring to FIGS. 6B and 7B) which have coincident centerlines L1 and L2 in the same manner as in the previous exemplary embodiment. Additionally, in the same manner as in the previous exemplary embodiment, the first and second elastic members 233 and 234 which are not buckled at a predetermined eccentric angle β may be mounted between a first support member 442 and the second support member 243.

In the present exemplary embodiment illustrated in FIGS. 10A and 10B, an eccentric member 450*a* may be provided so that the first support member 442 may deviate at the eccentric angle β from an axis of the second support member 243. In other words, in the same manner as in the previous exemplary embodiment, the separate eccentric member 450*a* may be provided instead of the first elastic member 233 to provide the eccentric force in the exemplary embodiment illustrated in FIGS. 5 through 8C.

The eccentric member 450*a* may be a leaf spring, a first end of which is fixed to the frame 241 and a second end of which elastically urges the first support member 442 to deviate from the axis of the second support member 243.

Similarly to the exemplary embodiment of FIGS. 5 through 8C, the diameter B" of a first opening 441*a* of a frame 441 may be greater than the first diameter A" of the first support member 442. Accordingly, the first support member 442 may be floatingly moved in upward and downward directions R1 and R2 by the moving unit 251 and eccentric member 450*a*.

Specifically, as illustrated in FIG. 10A, the first end 231 of the tension roller 230 is initially placed at the first position while being lifted in an upward direction R1 to the eccentric angle β by the elastic force of the eccentric member 450*a*. The first end 231 of the tension roller 230 may then be moved in the direction indicated by arrow F in combination with the meandering of the transfer belt 210 in the direction indicated by arrow F, and may be moved in a downward direction R2 by the first cam 252 having the inclined surface 252*a* and the second cam 253.

Therefore, as illustrated in FIG. 10B, the tension roller 230 may be disposed at the second position in which the axes S1 and S2 of the first end 231 and second end 232 of the tension roller 230 are coincident with each other, so that meandering of the transfer belt 210 may be stopped while the transfer belt 210 is rotating.

As described above, according to the various exemplary embodiments of the present general inventive concept, a tension roller is mounted so that a first end thereof may deviate from the axis of a shaft of the tension roller at a predetermined eccentric angle and may floatingly move, and when an orbit of a transfer belt is determined in advance, the axes of the first and second ends of the tension roller may be identified while rotating the transfer belt. Therefore, it is possible to prevent the transfer belt from meandering during rotation of the transfer belt, and it is thereby possible to improve the transfer efficiency. Additionally, damage caused by the meandering of a transfer belt may be prevented, and thus it is possible to use the transfer belt for a long period of time.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A transfer device comprising:

a transfer belt;

at least one pair of rollers to rotatably support the transfer belt;

a supporting unit to rotatably support both ends of the pair of rollers; and an eccentric unit to movably support a first end of a first roller of the pair of rollers with respect to the supporting unit such that the first end deviates from an axis of the first roller, wherein the first roller is a tension roller having a shaft protruding from both ends and being elastically supported by a first and a second elastic member which provide tension to the transfer belt, and the eccentric unit supports a first end of the tension roller to deviate from an axis of the shaft, where the supporting unit comprises: a frame; and a first and a second support member to allow the first and second ends of the tension roller to be securely supported on the frame, the first and second support members individually including a first shaft hole and a second shaft hole, respectively, into which the first and second ends of the tension roller are inserted, wherein the eccentric unit comprises:

the first elastic member;

a first supporting projection protruding from the frame to support a first end of the first elastic member; and a second supporting projection positioned such that an arbitrary centerline is located below an arbitrary centerline of the first supporting projection, the second supporting-projection protruding from the first support member so as to face the first supporting projection, to support a second end of the first elastic member.

2. The transfer device as claimed in claim 1, further comprising:

a first and a second opening formed on the frame to mount the first and second support members.

3. The transfer device as claimed in claim 2, wherein the first elastic member is mounted at the first opening between the frame and the first support member, and the second elastic member is mounted at the second opening between the frame and the second support member.

4. The transfer device as claimed in claim 3, wherein the diameter of the first opening is greater than a first diameter of the first support member to engage with the first opening such that the first support member can rotate at a substantially appreciable angle with respect to the frame, and the diameter of the second opening is equal to a second diameter of the second support member to engage with the second opening.

5. The transfer device as claimed in claim 1, wherein the eccentric unit further comprises:

a moving unit to cause the first end of the tension roller to move upwardly and downwardly by sliding movement of the tension roller combined with an elastic force of the first elastic member.

6. The transfer device as claimed in claim 5, wherein the moving unit movably supports the first end of the tension roller to be moved between a first position in which the first end of the tension roller deviates from the axis of the second end and a second position in which the first and second ends of the tension roller are coincident with the same axis.

7. The transfer device as claimed in claim 6, wherein the moving unit comprises:

a first cam having an inclined surface inclined at a predetermined angle, the first cam mounted at the first end of the tension roller; and a second cam protruding from the frame to be guided along the inclined surface in combination with the sliding movement of the tension roller.

8. A transfer device comprising:

a transfer belt;

at least one pair of rollers to rotatably support the transfer belt;

a supporting unit to rotatably support both ends of the pair of rollers; and an eccentric unit to movably support a first end of a first roller of the pair of rollers with respect to the supporting unit such that the first end deviates from an axis of the first roller, wherein the eccentric unit comprises an eccentric member to cause the first end of the first rollers to deviate from the axis, of the first roller, wherein the first roller is a tension roller having a shaft protruding from both ends and being elastically supported by a first and a second elastic member which provide tension to the transfer belt, and the eccentric unit supports a first end of the tension roller to deviate from an axis of the shaft, where the supporting unit comprises: a frame; and a first and a second support member to allow the first and second ends of the tension roller to be securely supported on the frame, the first and second support members individually including a first shaft hole and a second shaft hole, respectively, into which the first and second ends of the tension roller are inserted, wherein the eccentric unit comprises a leaf spring, a first end of which is fixed to the first support member and a second end of which elastically urges the first end of the tension roller to deviate from the axis of the second end in the inner portion of the first shaft hole.

9. The transfer device as claimed in claim 8, further comprising:

a first and a second opening formed on the frame to mount the first and second support members, wherein the diameter of the first shaft hole is greater than the diameter of the shaft of the tension roller, such that the shaft of the tension roller can floatingly move within the first shaft hole;

the diameter of the second shaft hole is equal to the diameter of the shaft of the tension roller; and the diameters of the first and second openings are equal to the diameters of the first and second support members to engage with the first and second openings.

10. The transfer device as claimed in claim 9, wherein a first and a second supporting projection extend from the frame and the first support member to support the first and second ends of the first elastic member, respectively; and a third and a fourth supporting projection extend from the frame and the second support member to support a first and a second end of the second elastic member, respectively.

11. The transfer device as claimed in claim 8, wherein the eccentric unit further comprises:

a moving unit to cause the first end of the tension roller to move upwardly and downwardly by sliding movement of the tension roller combined with an elastic force of the eccentric member.

12. The transfer device as claimed in claim 11, wherein the moving unit movably supports the first end of the tension roller to be moved between a first position in which the first end of the tension roller deviates from the axis of the second end and a second position in which the first and second ends of the tension roller are coincident with the same axis.

13. The transfer device as claimed in claim 12, wherein the moving unit comprises:

a first cam having an inclined surface inclined at a predetermined angle, the first cam mounted at the first end of the tension roller; and a second cam protruding from the frame to be guided along the inclined surface in combination with the sliding movement of the tension roller.

14. A transfer device comprising:

a transfer belt;

at least one pair of rollers to rotatably support the transfer belt;

a supporting unit to rotatably support both ends of the pair of rollers; and an eccentric unit to movably support a first end of a first roller of the pair of rollers with respect to the supporting unit such that the first end deviates from an axis of the first roller, wherein the first roller is a tension roller having a shaft protruding from both ends and being elastically supported by a first and a second elastic member which provide tension to the transfer belt, and the eccentric unit supports a first end of the tension roller to deviate from an axis of the shaft, where the supporting unit comprises: a frame; and a first and a second support member to allow the first and second ends of the tension roller to be securely supported on the frame, the first and second support members individually including a first shaft hole and a second shaft hole, respectively, into which the first and second ends of the tension roller are inserted, wherein the eccentric unit comprises: a leaf spring, a first end of which is fixed to the frame and a second end of which elastically urges the first support member to deviate from the axis of the second support member.

15. The transfer device as claimed in claim 14, wherein a first and a second supporting projection extend from the frame and the first support member to support the first and second ends of the first elastic member, respectively; and a third and a fourth supporting projection extend from the frame and the second support member to support a first and second ends of the second elastic member, respectively.

16. The transfer device as claimed in claim 14, wherein the eccentric unit further comprises:

a moving unit to cause the first end of the tension roller to move upwardly and downwardly by sliding movement of the tension roller combined with an elastic force of the eccentric member.

17. The transfer device as claimed in claim 16, wherein the moving unit movably supports the first end of the tension roller to be moved between a first position in which the first end of the tension roller deviates from the axis of the second end and a second position in which the first and second ends of the tension roller are coincident with the same axis.

18. The transfer device as claimed in claim 17, wherein the moving unit comprises:

a first cam having an inclined surface inclined at a predetermined angle, the first cam mounted at the first end of the tension roller; and a second cam protruding from the frame to be guided along the inclined surface in combination with the sliding movement of the tension roller.

19. An image forming apparatus comprising:

a main body, including an image forming unit; and a transfer device to transfer an image formed by the image forming unit to a printing medium, wherein the transfer device comprises:

a transfer belt;

at least one pair of rollers to rotatably support the transfer belt;

a supporting unit to rotatably support both ends of the pair of rollers; and an eccentric unit to movably support a first end of a first roller of the pair of rollers with respect to the supporting unit, the first end deviating from an axis of the first roller, wherein the first roller is a tension roller having a shaft protruding from both ends and being elastically supported by a first and a second elastic member which provide tension to the transfer belt, and wherein the eccentric unit supports a first end of the tension roller to deviate from an axis of the shaft, wherein the supporting unit comprises: a frame; and a first and a second support member to allow the first and second ends of the tension roller to be securely supported on the frame, the first and second support members individually including a first shaft hole and a second shaft hole, respectively, into which the first and second ends of the tension roller are inserted, wherein the eccentric unit comprises:

the first elastic member;

a first supporting projection protruding from the frame to support a first end of the first elastic member; and a second supporting projection positioned such that an arbitrary centerline is located below an arbitrary centerline of the first supporting projection, the second supporting projection protruding from the first support member to face the first supporting projection, to support a second end of the first elastic member.

20. The image forming apparatus as claimed in claim 19, wherein a first and a second opening are formed on the frame in order to mount the first and second support members.

21. The image forming apparatus as claimed in claim 20, wherein the first elastic member is mounted at the first opening between the frame and the first support member, and the second elastic member is mounted at the second opening between the frame and the second support member.

22. The image forming apparatus as claimed in claim 21, wherein the diameter of the first opening is greater than a first diameter of the first support member to engage with the first opening such that the first support member can rotate at a substantially appreciable angle with respect to the frame, and the diameter of the second opening is equal to a second diameter of the second support member for engagement with the second opening.

23. The image forming apparatus as claimed in claim 19, wherein the eccentric unit further comprises:

a moving unit to cause the first end of the tension roller to move upwardly and downwardly by sliding movement of the tension roller combined with an elastic force of the first elastic member.

24. The image forming apparatus as claimed in claim 23, wherein the moving unit movably supports the first end of the tension roller to be moved between a first position in which the first end of the tension roller deviates from the axis of the second end and a second position in which the first and second ends of the tension roller are coincident with the same axis.

25. The image forming apparatus as claimed in claim 24, wherein the moving unit comprises:

a first cam having an inclined surface inclined at a predetermined angle, the first cam mounted at the first end of the tension roller; and a second cam protruding from the frame to be guided along the inclined surface in combination with the sliding movement of the tension roller.

26. The image forming apparatus as claimed in claim 19, further comprising a guide unit to guide the floating movement of the transfer belt about the second end of the tension roller.

27. The image forming apparatus as claimed in claim 26, wherein the guide unit comprises:

a guide boss protruding from the transfer belt; and a guide member including a guide recess into which the guide boss is inserted, the guide member mounted at the second end of the tension roller.

28. An image forming apparatus comprising:

a main body, including an image forming unit; and a transfer device to transfer an image formed by the image forming unit to a printing medium;

wherein the transfer device comprises:

a transfer belt;

at least one pair of rollers to rotatably support the transfer belt;

a supporting unit to rotatably support both ends of the pair of rollers; and an eccentric unit to movably support a first end of a first roller of the pair of rollers with respect to the supporting unit, the first end deviating from an axis of the first roller, wherein the first roller is a tension roller having a shaft protruding from both ends and being elastically supported by a first and a second elastic member which provide tension to the transfer belt, and wherein the eccentric unit supports a first end of the tension roller to deviate from an axis of the shaft, wherein the supporting unit comprises: a frame; and a first and a second support member to allow the first and second ends of the tension roller to be securely supported on the frame, the first and second support members individually including a first shaft hole and a second shaft hole, respectively, into which the first and second ends of the tension roller are inserted wherein the eccentric unit comprises a leaf spring, a first end of which is fixed to the first support member and a second end of which elastically urges the first end of the tension roller to deviate from the axis of the second end in the inner portion of the first shaft hole.

29. The image forming apparatus as claimed in claim 28, further comprising:

a first and a second opening formed on the frame to mount the first and second support members, wherein the diameter of the first shaft hole is greater than the diameter of the shaft of the tension roller, such that the shaft of the tension roller can floatingly move within the first shaft hole;

the diameter of the second shaft hole is equal to the diameter of the shaft of the tension roller; and the diameters of the first and second openings are equal to the diameters of the first and second support members to engage with the first and second openings.

30. The image forming apparatus as claimed in claim 29, wherein a first and a second supporting projection extend from the frame and the first support member to support the first and second ends of the first elastic member, respectively; and a third and a fourth supporting projection extend from the frame and the second support member to support a first and a second end of the second elastic member, respectively.

31. The image forming apparatus as claimed in claim 28, wherein the eccentric unit further comprises:

a moving unit to cause the first end of the tension roller to move upwardly and downwardly by sliding movement of the tension roller combined with an elastic force of the eccentric member.

32. The image forming apparatus as claimed in claim 31, wherein the moving unit movably supports the first end of the tension roller to be moved between a first position in which the first end of the tension roller deviates from the axis of the second end and a second position in which the first and second ends of the tension roller are coincident with the same axis.

33. The image forming apparatus as claimed in claim 32, wherein the moving unit comprises:

a first cam having an inclined surface inclined at a predetermined angle, the first cam mounted at the first end of the tension roller; and a second cam protruding from the frame to be guided along the inclined surface in combination with the sliding movement of the tension roller.

34. An image forming apparatus comprising:

a main body, including an image forming unit; and a transfer device to transfer an image formed by the image forming unit to a printing medium, wherein the transfer device comprises:

a transfer belt;

at least one pair of rollers to rotatably support the transfer belt;

a supporting unit to rotatably support both ends of the pair of rollers; and an eccentric unit to movably support a first end of a first roller of the pair of rollers with respect to the supporting unit, the first end deviating from an axis of the first roller, wherein the first roller is a tension roller having a shaft protruding from both ends and being elastically supported by a first and a second elastic member which provide tension to the transfer belt, and wherein the eccentric unit supports a first end of the tension roller to deviate from an axis of the shaft, wherein the supporting unit comprises: a frame; and a first and a second support member to allow the first and second ends of the tension roller to be securely supported on the frame, the first and second support members individually including a first shaft hole and a second shaft hole, respectively, into which the first and second ends of the tension roller are inserted, wherein the eccentric unit comprises: a leaf spring, a first end of which is fixed to the frame and a second end of which elastically urges the first support member to deviate from the axis of the second support member.

35. The image forming apparatus as claimed in claim 34, wherein a first and a second supporting projection extend from the frame and the first support member to support the first and second ends of the first elastic member, respectively; and a third and a fourth supporting projection extend from the frame and the second support member to support a first and second ends of the second elastic member, respectively.

36. The image forming apparatus as claimed in claim 34, wherein the eccentric unit further comprises:

a moving unit to cause the first end of the tension roller to move upwardly and downwardly by sliding movement of the tension roller combined with an elastic force of the eccentric member.

37. The transfer device as claimed in claim 36, further comprising a guide unit to guide the floating movement of the transfer belt about the second end of the tension roller.

38. The transfer device as claimed in claim 37, wherein the guide unit comprises:

a guide boss protruding from the transfer belt; and a guide member including a guide recess into which the guide boss is inserted, the guide member mounted at the second end of the tension roller.

39. The image forming apparatus as claimed in claim 36, wherein the moving unit movably supports the first end of the tension roller to be moved between a first position in which the first end of the tension roller deviates from the axis of the second end and a second position in which the first and second ends of the tension roller are coincident with the same axis.

40. The image forming apparatus as claimed in claim 39, wherein the moving unit comprises:

a first cam having an inclined surface inclined at a predetermined angle, the first cam mounted at the first end of the tension roller; and a second cam protruding from the frame to be guided along the inclined surface in combination with the sliding movement of the tension roller.

* * * * *